US007985127B2

(12) United States Patent
Cutter et al.

(10) Patent No.: US 7,985,127 B2
(45) Date of Patent: Jul. 26, 2011

(54) GOLF SOLITAIRE VIDEO GAME

(75) Inventors: John Mitchell Cutter, Sammamish, WA (US); Glen DeBiasa, Hillsborough, NJ (US)

(73) Assignee: Big Fish Games, Inc., Seattle, WA (US)

( * ) Notice: Subject to any disclaimer, the term of this patent is extended or adjusted under 35 U.S.C. 154(b) by 997 days.

(21) Appl. No.: 11/756,496

(22) Filed: May 31, 2007

(65) Prior Publication Data

US 2008/0300032 A1 Dec. 4, 2008

(51) Int. Cl.
*A63A 1/00* (2006.01)

(52) U.S. Cl. ..... 463/11; 463/9

(58) Field of Classification Search ..... 463/11–13
See application file for complete search history.

(56) References Cited

U.S. PATENT DOCUMENTS 5,653,635 A 8/1997 Breeding
5,971,849 A * 10/1999 Falciglia ..... 463/16
6,942,565 B2 * 9/2005 Karn et al. ..... 463/11
7,416,186 B2 * 8/2008 Walker et al. ..... 273/292
2004/0130099 A1 7/2004 Inverso
2005/0101386 A1 5/2005 Lavanchy et al.
2006/0217189 A1 9/2006 Walker et al.
2007/0035092 A1 * 2/2007 Flores ..... 273/298
2008/0182664 A1 * 7/2008 Kaplan et al. ..... 463/42

OTHER PUBLICATIONS

PCT International Search Report and Written Opinion for Application No. PCT/2008/065288 mailed on Sep. 2, 2008, 11 pages.

* cited by examiner

*Primary Examiner* — Melba Bumgarner
*Assistant Examiner* — Lawrence Galka
(74) *Attorney, Agent, or Firm* — Lee & Hayes, PLLC

(57) ABSTRACT

A Golf Solitaire Video Game is described in which a user plays a video playing card game. Playing cards are positioned in piles where one pile initially contains only a home playing card. The playing cards on top of the piles and the home playing card reveal their front sides, and the playing cards that are positioned in the pile below the top playing card display their back sides or front sides. The game player moves the playing cards onto the home card in a contiguous order of the symbols on the cards. The back sides of the playing cards, underneath the removed top playing cards, are revealed when the top playing cards are placed on the home playing card. A score is provided corresponding to a number of cards that remain in the one or more piles after placing playing cards onto the home playing card in the contiguous order.

12 Claims, 11 Drawing Sheets

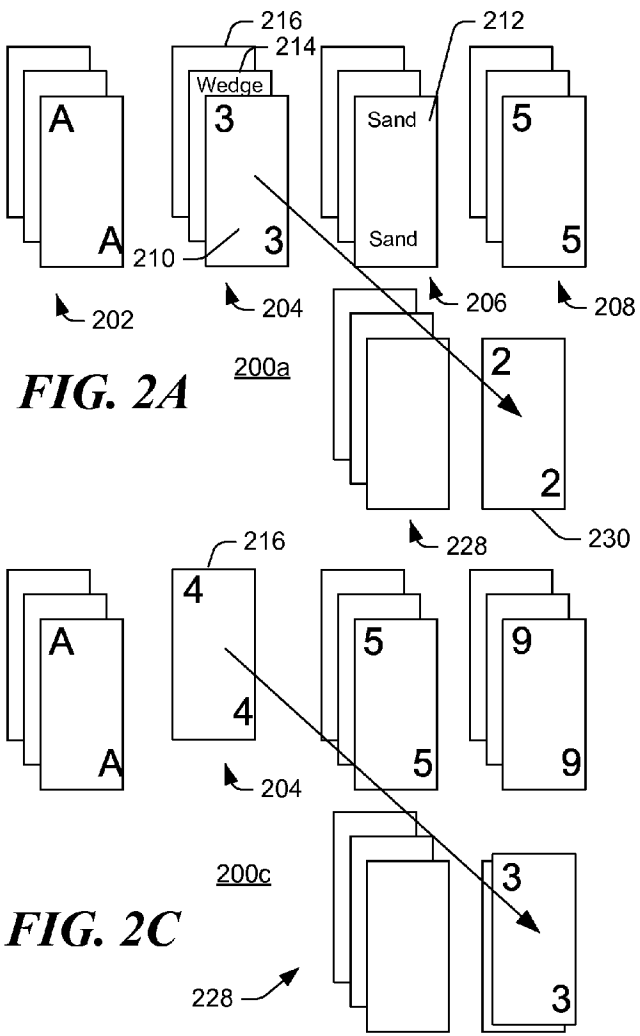
FIG. 2A
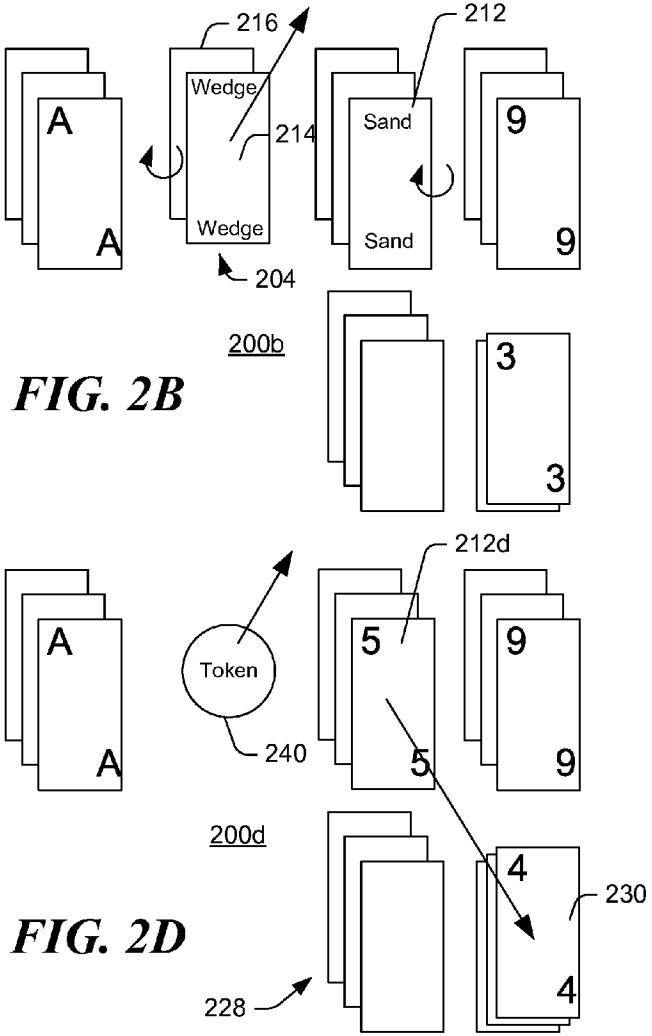
FIG. 2B
FIG. 2C
FIG. 2D

GOLF SOLITAIRE VIDEO GAME

BACKGROUND

Currently, solitaire electronic video games use playing cards that are placed in piles in a video game window. Playing cards typically have a front (or face) where a symbol, such as a character, number or letter, is displayed, and a back that does not display the symbol. The playing cards are then removed by the game player from one pile of cards and are positioned onto a base pile of cards in a logical order related to the symbol on the card front. The objective of the game is for the game player to move the cards in such a manner as to completely eliminate all the cards from one or more of the piles. In these games the score based on time or number of cards eliminated in a single round. Further the symbol on the front of the playing cards that is on the top of the each of the piles is always shown. Accordingly the cards that can be selected is only limited to those cards that can be used to maintain the logical order.

SUMMARY

A computer implemented video game is described in which piles containing virtual playing cards are displayed. The piles have a top playing card with a front (or face side) and a back side. Symbols, such as letters or numbers, are placed on its front side. The back side conceals the symbols. The top playing card reveals its front side, and the other playing cards that are positioned in the pile below the top playing card display their back sides or front sides. A virtual home playing card is positioned in its own pile and its front side is displayed. During a hole of play, the game player moves the playing cards over a home card in a contiguous order of the symbols on the cards and may include moving an Ace card onto a King card and vice versa. The playing card displaying its back side, in the pile underneath the removed top playing card, reveals its front side when the top playing card is placed on the home playing card. A score is provided corresponding to a number of cards that remain in the piles after placing playing cards from the piles onto the home playing card in the contiguous order. In additional holes of the game, the order, location and display of the playing cards face are different in the holes to create a unique look and feel for each hole. Moreover the game may include either 9 or 18 separate layouts corresponding to a traditional golf course, where the layout scores are added together to get the final course score for the round of golf. Reaching a minimal final course score for the round can be used to unlock additional courses.

This summary is provided to introduce a selection of concepts in a simplified form that are further described below in the Detailed Description. This Summary is not intended to identify key or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference number in different figures indicates similar or identical items.

DETAILED DESCRIPTION

Figure 1A:
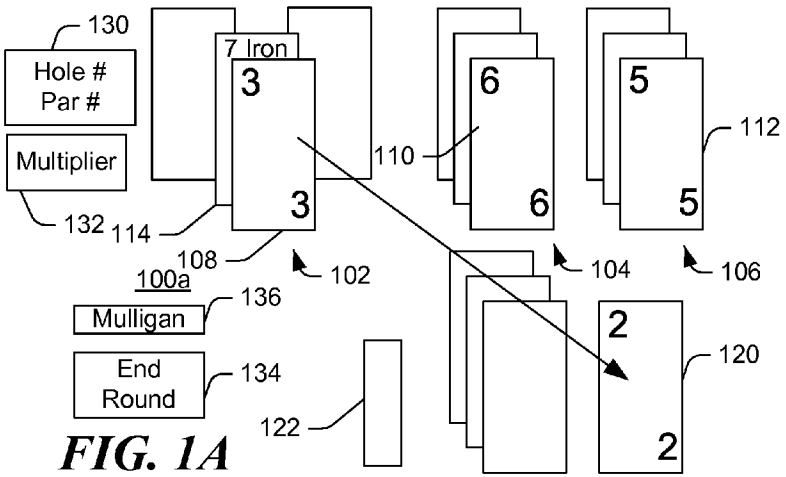
FIGS. 1-4 are a depiction of a sequence of screen shots illustrating the playing the golf solitaire video game.

The following document describes method(s) or software capable of instantiating a computer video game. The video game may be executed on any electronic device such as a computer, PDA, computer laptop or gaming device. The computer game software is operable to enable a game user to find hidden objects in the video game.

The construction of the video game and an environment in which this video game may be enabled by techniques is set forth first below. This is followed by others sections describing various inventive techniques and illustrative embodiments of other aspects of the video game.

Illustrated in FIGS. 1A-1D are exemplary displays 100(*a*-*d*) of a sequence of four scenes, respectively, that make up an exemplary course and in which a game player may encounter when playing the golf solitaire video game. The display 100*a* shows a plurality of game piles 102-106 of virtual playing cards (herein referred to as "playing card piles"), such as playing cards 108-114, stock pile 118, home playing card 120 and bag 122. Although three playing card piles are shown, the game may easily be adapted to have any number of playing card piles. Further, the layout on each course may have a unique look and feel, as dictated by one or more of the following: the number and location of the piles, the number of cards in each piles, which cards are face up and which are face down, the location of sand traps, the location of water hazards and the location sand wedges.

Each of the playing cards have a front side and a back side, where the front side displays one or more symbol, that may include characters, letters or numbers, or words or any combination thereof. The back hides or conceals the symbols and may includes a drawing, photograph or pattern. The virtual playing cards represent a graphical depiction of ordinary playing cards. Also the playing cards may depict an ordinary golf club, such as an iron or sand wedge. The playing cards may also indicate a golf hazard such as a sand trap or a water trap. The use of these special cards will be apparent in the following description.

The game is played by the game player moving cards from one of the playing card piles 102-106, or from stock pile 118 onto home playing card 120. The moved card becomes the new home playing card. The cards are moved in a continuous sequence until all cards in stock pile 118 are depleted and there are no more cards having a number in sequence above or below the value displayed on the current home playing card 120. The game player may end the hole at any time by selecting the end hole button 134.

In one embodiment, the cards in the stock pile 118 display their back side until moved over the home playing card 120 and then reveal their front side. A bag 122 is shown in which will hold one or more clubs. Clubs when selected from piles 102-106 are placed in bag 122.

Status indicator 130 may be displaying that indicates the hole of the golf solitaire game is being played and the par value for the hole. The par value is used to determine a score for the hole and is used to determine the score for the current hole. The score, in one example, may be calculated by subtracting the par value from the number of cards that remain to the number of cards remaining after all the playing cards can possibly be played. A multiplier indicator 132 may also be provided that is used to compute award points. The multiplier may be increased in relation to the number of playing cards in a row that are placed on the home card before a stock card is selected. An End Hole selector button 134 may be displayed in which the game player can select to end the current hole. Although the status and multiplier indicator buttons 130 and 132 are only shown in FIG. 1A, these indicators may be shown in every scene.

Referring to FIG. 1A, game play is commenced by cards being placed in a random or a predetermined order in piles 102-106, stock pile 118 and one card being placed in its own pile as home playing card 122. In one example the game player, selects card 108 (using an input device) for placement over home card 120. In one embodiment a mulligan button 136 appears at the bottom of the screen. The mulligan button can be used once per hole and allows a game player to "undo" any card that they played to the home card.

Figure 1B:
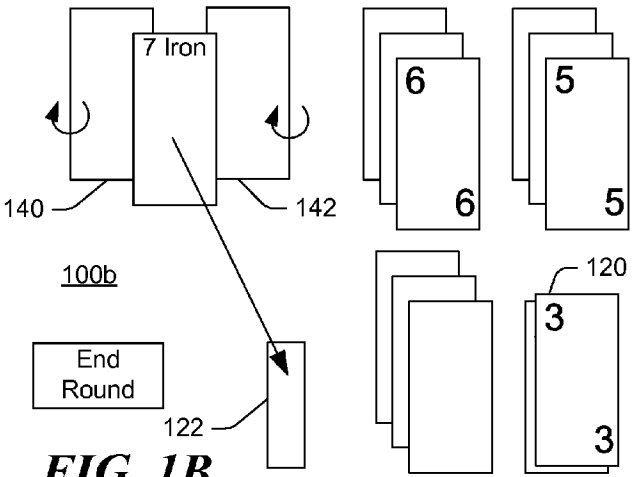

Referring to FIG. 1B, the game player selects a seven Iron 114 which removed from pile 104 and is then automatically moved to bag 122. Further, playing cards 140 and 142, which initially display their back side, automatically flip over to display their front side (See FIG. 1C) and the symbols that appear on the front side.

Figure 1C:
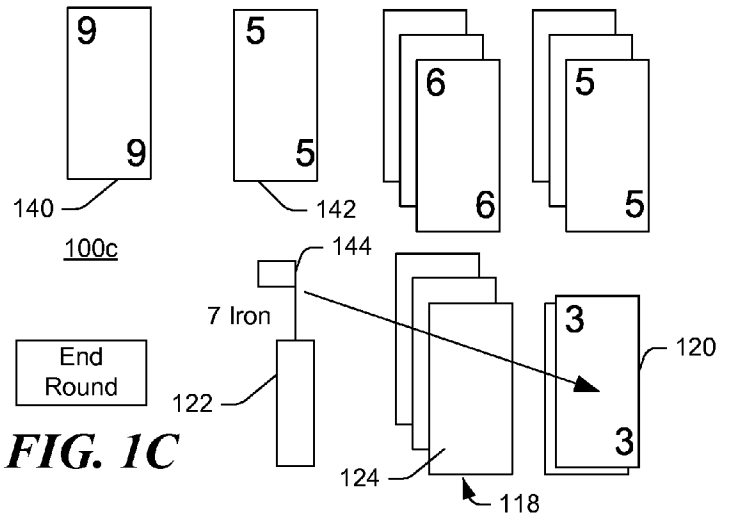
Figure 1D:
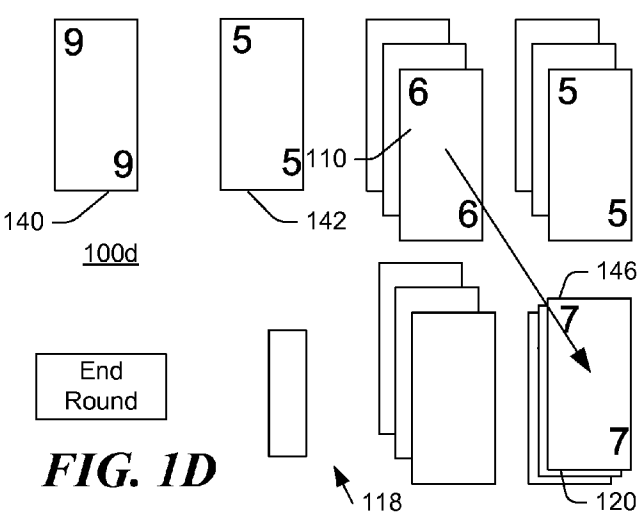

Referring to FIG. 1C, the game player may then optionally select a playing card 124 from stock pile 118, or may select the seven iron 144 for placement into bag 122. For the purposes of example, the game player selects the seven iron, which is converted to a playing card 146 indicating the number 7. Referring to FIG. 1D, the playing card 146 is placed over home playing card 120 and becomes the new home card. In one embodiment, the game player can subsequently place game card 110 (e.g. a 6 card) onto playing card 120 (e.g. a 7 card). Alternatively, the game player can select a card from stock pile 118 for placement onto home playing card 120.

Illustrated in FIGS. 2A-2D are exemplary displays 200(*a*-*d*) of another sequence of four scenes, respectively, that a user may encounter when playing the golf solitaire video game. The display 200*a* includes a plurality of piles 202-208 of virtual playing cards, such as playing cards 210-216, stock pile 228, and home playing card 230.

Referring to FIG. 2A, in another embodiment game play is commenced by cards being placed in a random order in piles 202-208, stock pile 228 and a card being placed in its own pile as home playing card 230. In one example the game player, selects card 210 (using an input device) for placement over home card 230.

Referring to FIG. 2B, the game player selects wedge card 214 which is then automatically removed from pile 204. Further, playing cards 212 and 216, which initially display their back side, automatically flip over to display their front side (See FIG. 2C) and symbols on the front (4 and 5 card, respectively).

Referring to FIG. 2C, the game player may then optionally select a playing card from stock pile 228, or may select the playing card 216 (displaying a 4) for placement onto home card 230. For the purposes of example, the game player selects the card 216 which becomes the new home card. Further in one embodiment, since card 216 is the last card in the pile 204, a token 240 appears (See FIG. 2D) and points are automatically awarded to the game player.

Referring to FIG. 2D, the game player can place playing card 212*d* (a 5 card) over home playing card 230 (a 4 card) and so that card 212*d* becomes the new home card. Alternatively, the game player can select a card from stock pile 228 for placement onto home playing card 230.

Figure 2E:
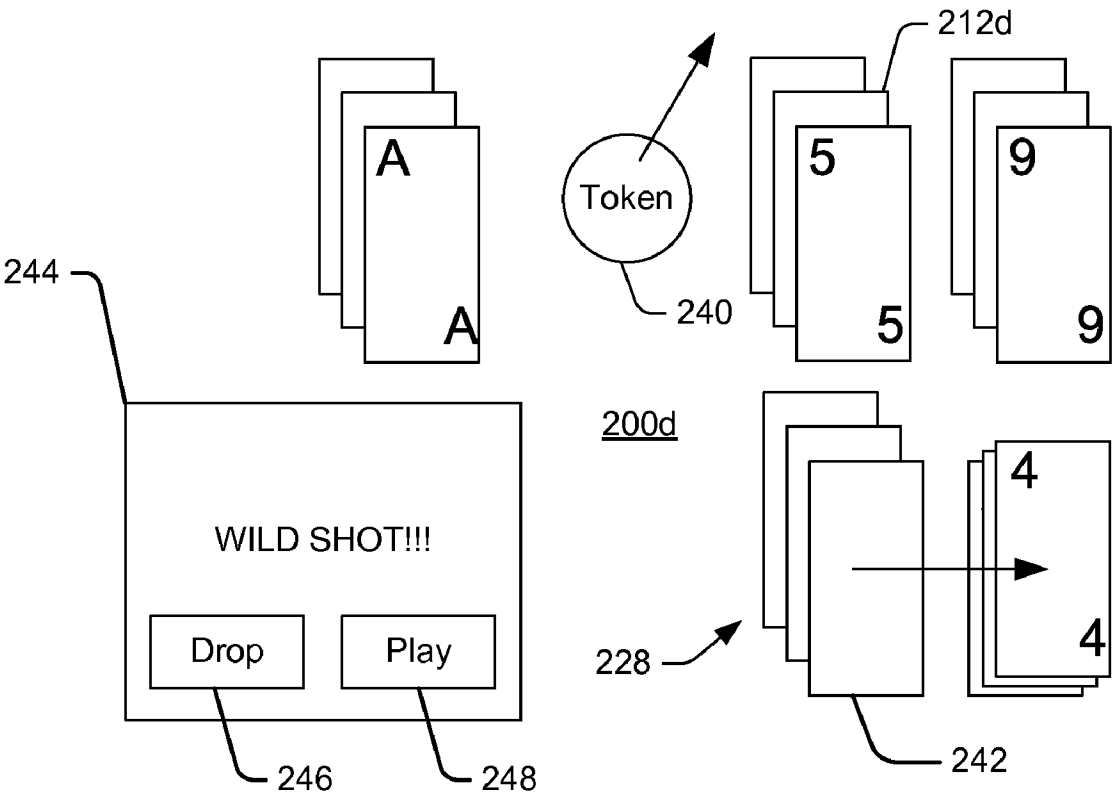

Referring to FIG. 2E, when players turn over a card 242 from stock pile 228, a "Wild Shot" card may automatically appear in a separate popup dialogue box 244. When this occurs a game player can either select a "Drop" the card button 246 (with a penalty) or "Play" the card button 248. If the game player chooses the latter, there is a shuffling effect and a unique card is randomly chosen. Selection of these wild shot cards 242 can result in: adding or removing cards from play, adding or removing scoring tokens, and adding or reducing the scoring multiplier.

In another embodiment, a jackpot card will randomly appear in one of the card piles as cards are revealed. If a game player removes enough cards, the game player can select and play this jackpot card. Upon being played, a jackpot card is automatically converted into a jackpot spin that results in awarding a small to very large numbers of tokens to the game player.

Figure 2F:
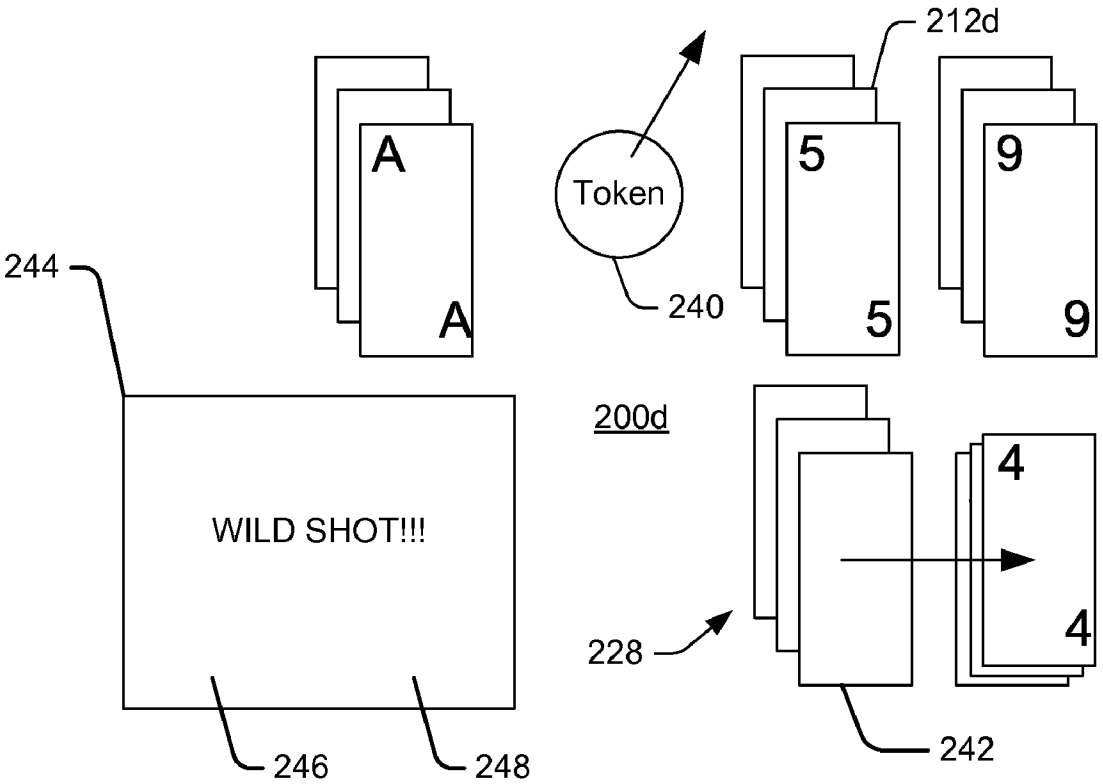

Also in one embodiment of the video game referring to FIG. 2F, the Wild Shot Cards 242 indicates a gopher who steals all tokens for the hole, reduces the multiplier to the start (e.g. one), and adds cards back to piles for the hole. Further one of the Wild Shot Cards 242 may results in an animation indicating the gopher being flushed out of his hole. When this occurs, everyone 256(1) . . . 256(N) in the same internet chat room 250 as the game player 256(1) earns tokens 252 as part of a "shared" event. The chat window 250 indicates that the game player 256(1) just flushed the gopher and everyone in the room 256(1) . . . 256(N) earns a predetermined number of tokens 252. When player 256(1) flushes the gopher, a message is sent from the client application to a server program. The server program then sends the message to the client applications for all players 256(1) . . . 256(N) in the same chat room 250. When each application receives this message, the players 256(1) . . . 256(N) are automatically awarded the "flush the gopher" tokens 254 which are subsequently sent to the server and saved to a server database. Each player's 256 (1) . . . 256(N) client application also displays a message for the game player 256(1) in the chat room 250.

Illustrated in FIGS. 3A-3D are exemplary displays 300(*a*-*d*) of another sequence of four scenes, respectively, that a user may encounter when playing the golf solitaire video game. The display 300*a* includes a plurality of piles 302-308 of virtual playing cards, such as playing cards 310-322, stock pile 328, and home playing card 330. In one embodiment, pile 306 is a special water hazard pile that must have its playing card removed or played before the front side of cards in pile 308 can be revealed.

Figures 3A, 3B, 3C, 3D:
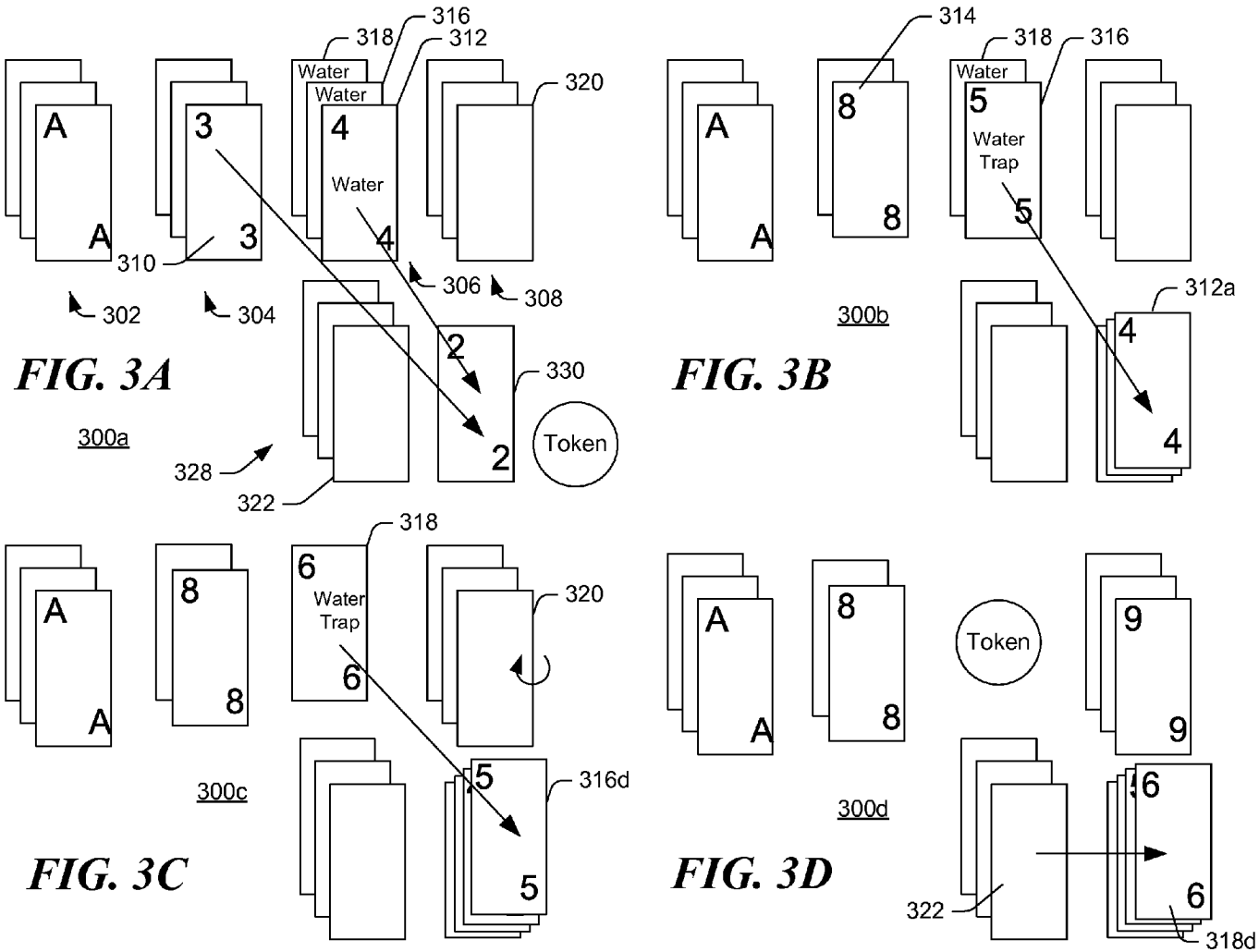

Referring to FIG. 3A, game play is commenced by cards being placed in a random order in piles 302-308, stock pile 328 and by one card being placed in its own pile as home playing card 330. In one example the game player, selects (using an input device) card 310 (e.g. a 3 card) and subsequently card 312 (e.g. a 4 card and a water hazard card) for placement over home card 330 (e.g. a 2 card). Upon placement of cards 310 and 312, the front of cards 314 and 316 are subsequently revealed (See FIG. 3B).

Referring to FIG. 3B, the game player selects card 316 (e.g. a 5 card and a water hazard card) for placement over card 312 (e.g. a 4 card) and home card 330. Upon placement of cards 316, the front of card 318 (e.g. a 6 card and a water hazard card) is subsequently revealed (See FIG. 3C).

Referring to FIG. 3C, the game player may then optionally select a playing card from stock pile 328, or may select the playing card 318 (displaying a 6 and the last water hazard card) for placement onto card 316*c* (e.g. the 5 card) and home card 330. For the purposes of example, the game player selects the card 318 which becomes the new home card. Further in one embodiment, since card 318 is the last card in the pile 306, a token appears (See FIG. 3D) and points are awarded to the game player. Also since card 318 is the last card in the water trap/hazard pile, the top playing card 320 in the pile 308 is flipped so that the front side of card 320 is revealed. Although playing card 320 is shown, for example, in an adjacent pile 308, playing card 320 could be in any pile regardless of whether or not the pile is adjacent to pile 306.

Referring to FIG. 3D, since there are no cards in sequence higher or lower than card 318*d*, e.g. the new home playing card 318*d* is a 6 card, the game player must select a card 322 from the stock pile 328 for placement onto home playing card 318*d*.

Figure 4:
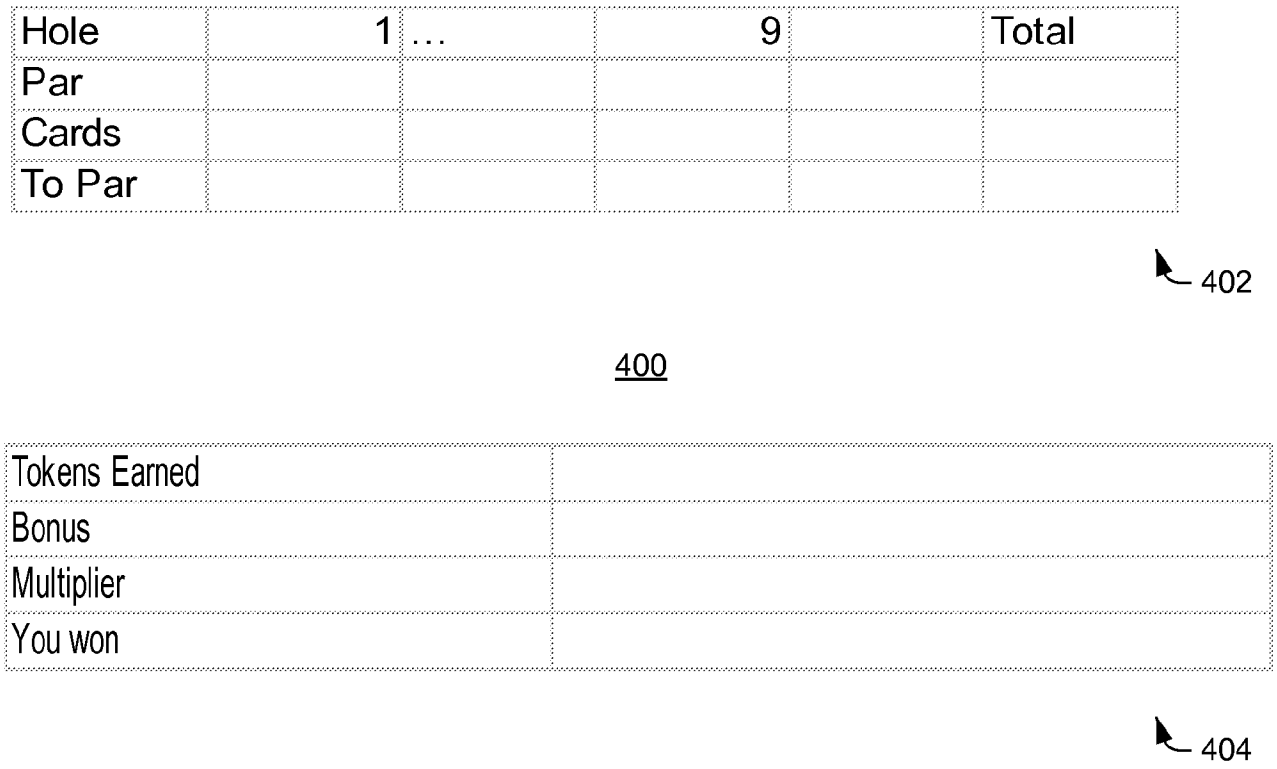

Illustrated in FIG. 4 are exemplary score indication 400 that includes table 402 and 404. Tables 402 and 404 are displayed as part of the video game after each hole is played. The score table 402 indicates the hole, the par of the hole, the number of cards left to be played and the score of the game player with respect to par.

Score table 404 indicates the number of tokens (or points) earned by the game player, any additional bonus points for completing the hole or reaching a certain par level, the multiplier for the hole and the total number of points earned during each hole. In one embodiment, certain golf rounds (e.g. 9 or 18 holes) may be unlocked and available to the game player to play only if the game player is less than a predetermined score, for example, if the score is less than par. Other ways that the game player can unlock a new course may include: creating a long drive "run" greater than a predetermined amount, earning more than a predetermined amount of tokens, and achieving a predetermined number of perfect scores in a hole.

In one embodiment, an internet chat room that is displayed on the display in a window adjacent the video game. When a game player unlocks a new course, there is an automatically generated announcement (through the chat room) to all the other game players playing the video game about the unlocking of the new course.

Figure 5:
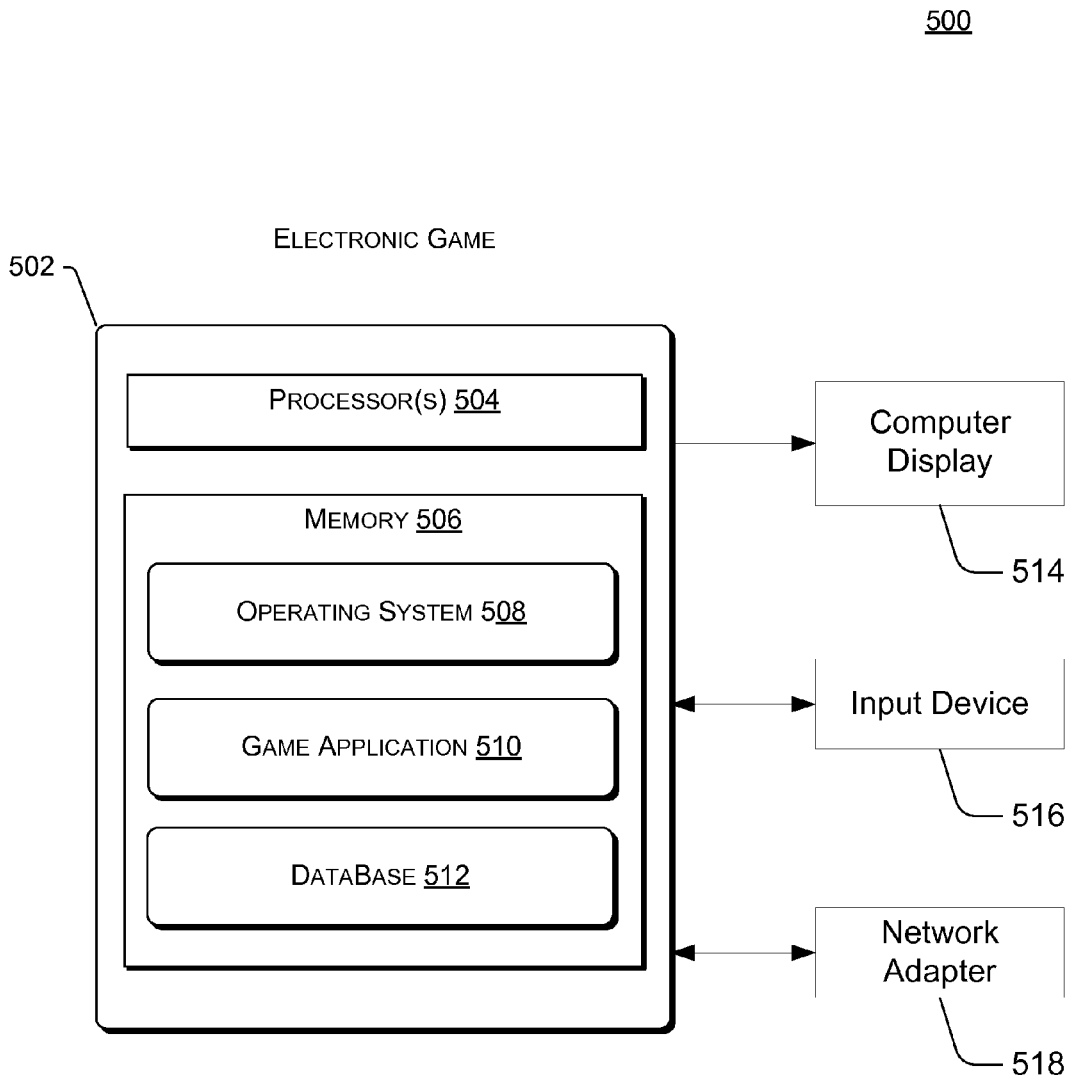
FIG. 5 is depicted an example system in which the golf solitaire video game may be implemented.

The computer environment 500 illustrated in FIG. 5 is a general computer environment that includes a user interface which can provide a computer video game to a game player; the computer video game may include playing the golf solitaire video game. Similar resources may use the computer environment and the processes as described herein. The computer environment 500 is only one example of a computer environment and is not intended to suggest any limitation as to the scope of use or functionality of the computer and network architectures. Neither should the computer environment 500 be interpreted as having any dependency or requirement relating to any one or combination of components illustrated in the exemplary computer environment 500.

The computer environment 500 includes a general-purpose computing device in the form of a computer 502. The computer 502 can be, for example, one or more of a stand alone computer, laptop computer, a networked computer, a mainframe computer, a PDA, a telephone, a microcomputer or microprocessor, or any other computer device that uses a processor in combination with a memory. The components of the computer 502 can include, but are not limited to, one or more processors or processing units 504, a system memory 506, and a system bus (not shown) that couples various system components including the processor 504 and the system memory 506.

The computer 502 can comprise a variety of computer readable media. Such media may be any available media that is accessible by the computer 502 and includes both volatile and non-volatile media, and removable and non-removable media. The process for creating and playing the video game can be stored as instructions sets on the computer readable media.

The system memory 506 may include the computer readable media in the form of non-volatile memory such as read only memory (ROM) and/or volatile memory such as random access memory (RAM).

The computer 502 may also include other removable/non-removable, volatile/non-volatile computer storage media. By way of example, memory 506 may include a hard disk drive (not shown) for reading from and writing to a non-removable, non-volatile magnetic media (not shown), and an optical disk drive, for reading from and/or writing to a removable, non-volatile optical disk such as a CD-ROM, DVD-ROM, or other optical media. The hard disk drive and optical disk drive may each be directly or indirectly connected to the system bus.

The disk drives and their associated computer-readable media provide non-volatile storage of computer readable instructions, program modules, and other data for the computer 502. Although the example depicts a hard disk within the hard disk drive, it is to be appreciated that other types of the computer readable media which can maintain for accessing data that is accessible by a computer, such as non-volatile optical disk drives, floppy drives, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like, can also be utilized to implement the exemplary computer environment 500.

Memory 506 may be a magnetic disk non-volatile optical disk, ROM and/or RAM. Stored in memory 506, including by way of example, may be an operating system (OS) 508, one or more video game applications 510, and database 512.

A player can enter commands and information into the computer 502 via input devices 516 such as a keyboard and/or a pointing device (e.g., a "mouse") which send a signal to the computer 502 in response to commands from the game player. Other input devices (not shown specifically) may include a microphone, joystick, game pad, satellite dish, serial port, scanner, and/or the like. These and other input devices are connected to the processing unit 504 via input/output interfaces (not shown) that are coupled to the system bus of computer 502, but may be connected by other interface and bus structures, such as a parallel port, game port, or a universal serial bus (USB).

A monitor, flat panel display, or other type of computer display 514 can also be connected to the system bus via a video interface (not shown), such as a video adapter. In addition to the computer display 514, other output peripheral devices can include components such as speakers (not shown) which can be connected to the computer 502.

The computer 502 can operate in a networked environment using logical connections to one or more remote computers, such as a remote computer device through network adapter 518. By way of example, the remote computer device can be a personal computer, portable computer, a server, a router, a network computer, a peer device or other common network node, game console, and the like. The remote computer device can be a server that can include many or all of the elements and features described herein relative to the computer 502.

Logical connections between the computer 502 and the remote computer device (e.g. a service provider) are depicted as an Internet (or Intranet) which may include a local area network (LAN) and/or a general wide area network (WAN). Video game application 510 may be initially stored on the server and be downloaded from the internet onto memory 506 in computer 502. Computer 502 may communicate to the remote computer device using any communications media.

Various modules and techniques may be described herein in the general context of the computer-executable instructions, such as program modules, executed by one or more computers or other devices. Generally, program modules include routines, programs, control objects, components, control node data structures, etc. that perform particular tasks or implement particular abstract data types. Often, the functionality of the program modules may be combined or distributed as desired in various embodiments.

Operating system 508 manages the interaction between the various applications, modules and tools in memory 506 and devices 514-518. Operating system 508 may a window operating system available from Microsoft Corp. of Redmond, Wash. or may include a middleware interfaces such as Flash by Adobe Inc. of San Jose, Calif. or Java by Sun Inc. of Santa Clara, Calif. Game application 510 may communicate with the operating system directly or via the middleware interface. The score of the game player of the level reached by the player may be stored in database 512.

Various modules and techniques may be described herein in the general context of the computer-executable instructions, such as program modules, executed by one or more computers or other devices. Generally, program modules include routines, programs, control objects, components, control node data structures, etc. that perform particular tasks or implement particular abstract data types. Often, the functionality of the program modules may be combined or distributed as desired in various embodiments.

An implementation of the aforementioned computer video game may be stored on some form of the computer readable media (such as optical disk) or transmitted from the computer media via a communications media to a user computer. Computer readable media can be any available media that can be accessed by a computer. By way of example, and not limitation, computer readable media may comprise "computer storage media" and "communications media."

"Computer storage media" includes volatile and non-volatile, removable and non-removable media implemented in any process or technology for storage of information such as computer readable instructions, control node data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

Exemplary Process

The exemplary process, shown in FIGS. 6A-6F, is illustrated as a collection of blocks in a logical flow diagram. The flow diagram is an exemplary process 600 used by processor 504 (see FIG. 5) in system 500, to play the solitaire video game and represents a sequence of operations that can be implemented in hardware, software, and a combination thereof. In the context of software, the blocks represent computer-executable instructions that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the process. For discussion purposes, the processes are described with reference to system 500 of FIG. 5, although it may be implemented in other system architectures.

The golf solitaire video game is launched in block 602. When launched, playing cards are placed in a random order in three or more piles. In one embodiment most courses have five or six piles. One of the piles contains a home card, and one of the piles contains a stock pile. In one embodiment the stock pile has one card facing up with the remaining playing cards positioned face down. One or more of the piles will be the playing card piles that contain the playing cards that will be put into play.

In block 604, the front side of the top playing card on each of the playing card piles will be revealed along with the front side of the home card. The hole number, the current score and the par for the current hole will also be displayed. Also displayed is an "End hole" button, which may be selected at any time.

Figure 6A:
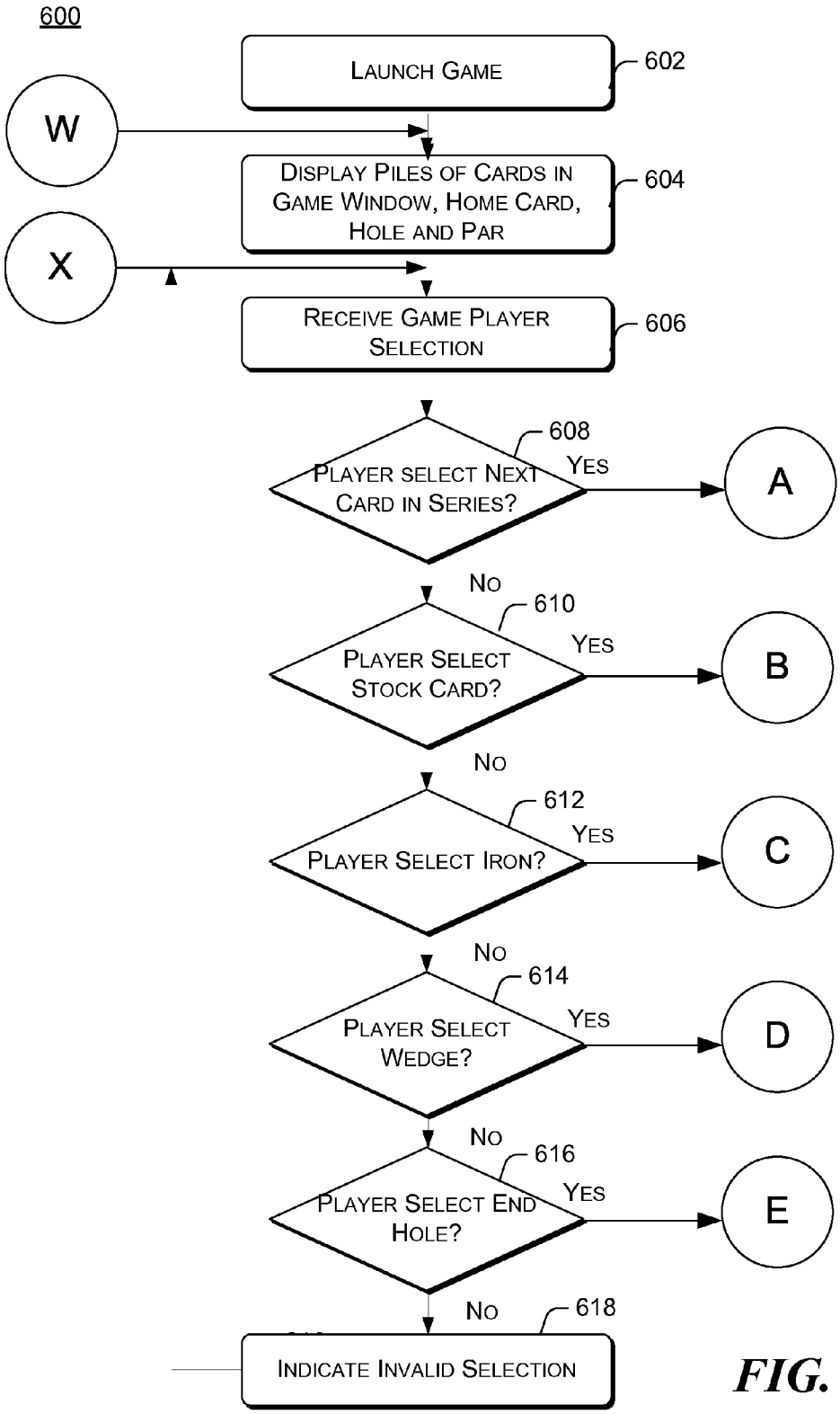
FIGS. 6A-6F are a depiction of an illustrative process for playing the golf solitaire video game.
Figure 6B:
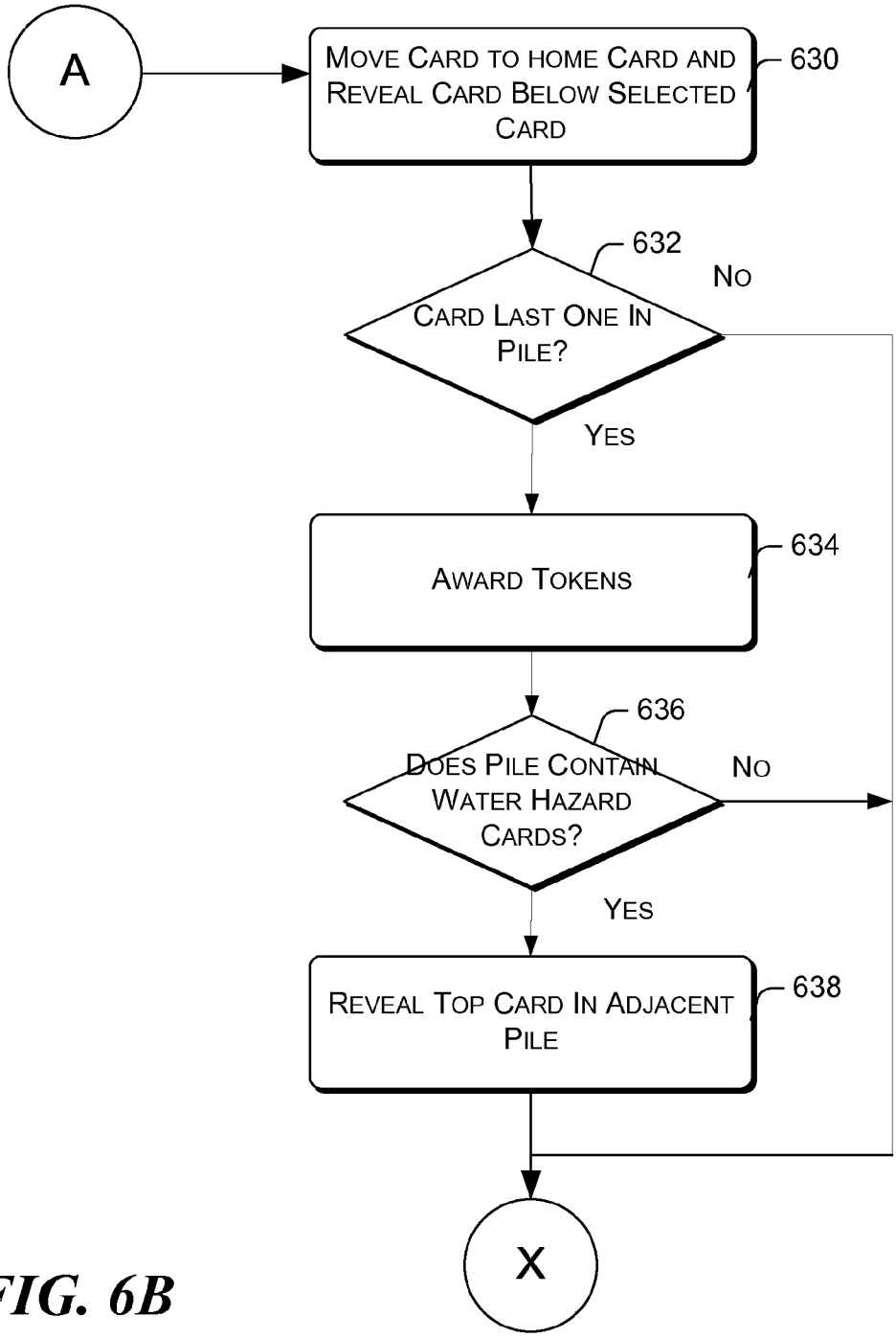

In block 606, the game player selects one of the cards to be placed over the home card or the game player selects the end hole button. In blocks 608-616 a determination is made as to what the game player selected. In block 608, a determination is made whether the game player selected a playing card from a playing card pile that is a next card in playing card order sequence to the home card (e.g. the home card +1 or −1). If it is next in sequence ("yes" to block 608), the selected card is moved to be positioned on the home card, and the card positioned on the pile below the selected card is revealed in block 630 (FIG. 6B). If the card is not the next card in sequence to the home card ("no" to block 608), then a determination is made, in block 610, as to whether the game player selected a card from the stock pile.

Figure 6C:
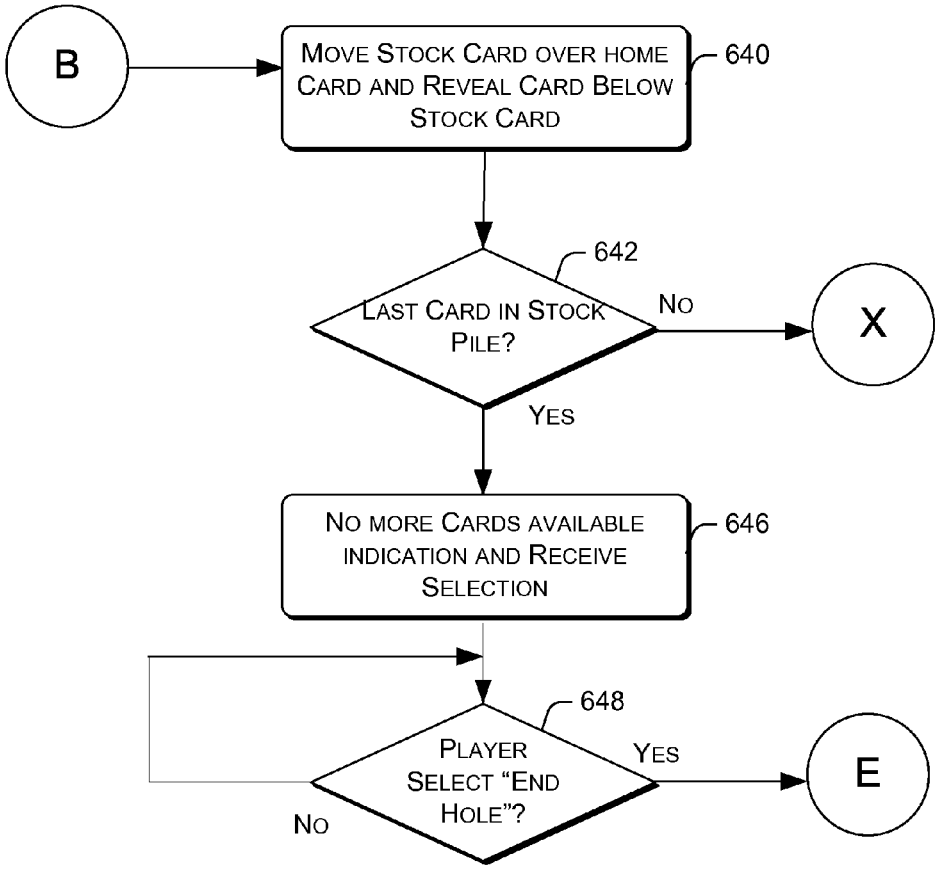

In block 610, a determination is made whether a stock card was selected. If the player selected a card from the stock pile ("Yes" to block 610), the selected stock card is moved to be positioned on the home card, and the card on the stock pile below the selected stock card may be revealed in block 640 (FIG. 6C). If the selection is not from the stock pile ("no" to block 610), then a determination is made, in block 612, as to whether the player selected an iron card from one of the playing card piles.

In block 612, a determination is made whether or not an iron club was selected. If the player selected an iron club card, ("Yes" to block 612), then the selected iron (club) card is moved to the bag and displayed in block 650 FIG. 6D). If the selection is not an iron club card ("no" to block 612), then a determination is made, in block 614, as to whether the player selected a wedge club card from one of the playing card piles.

In block 614, a determination is made whether a wedge was selected. If the player selected a wedge card, ("Yes" to block 614), then the selected wedge card is removed and a sand card on the pile adjacent the selected wedge card may be revealed in block 660 (FIG. 6E). If the selection is not a wedge card ("no" to block 614), then a determination is made, in block 616, as to whether the player selected an end hole button.

In block 616, a determination is made whether the game player selected the end hole button. If the player selected an end hole card, ("Yes" to block 616), then the score is computed and displayed in block 670 (FIG. 6F). If the selection is not an end hole card ("no" to block 616), then an invalid selection indication is provided on the display to the game player and another selection is received in block 606.

In block 618, an invalid indication is provided to the display for the game player. The game then proceeds back to receive the user selection in block 606.

Referring to FIG. 6B, in block 630, the card selected by the game player is moved over the home card. If there is a card below the selected card, it is then revealed. The game then proceeds to block 632 where a determination is made as to whether the selected card was the last card in a pile. If it was, ("yes" to block 632), the game player is awarded, in block 634, a token or a predetermined award value. A determination is then made, in block 636, as to whether the selected card indicates a water hazard. If it does indicate a water hazard ("yes" to block 636), the front of the top card in a pile indicated as a water trap or hazard is revealed in block 638. In one embodiment the pile is adjacent the pile from which the game player selected the hazard card. If the card is the last one in the pile or if the pile does not contain a water hazard card ("No" to block 632 or block 636), the process then proceeds to block 606 where another selection is received (FIG. 6A).

Referring to FIG. 6C, the selected stock card is revealed. The revealed card is moved to be positioned on the home card, and the card on the stock pile below the selected stock card may be available for selection in block 640. Next in block 642, a determination is made whether the selected card is the last card in the stock card pile. If it is, ("yes" to block 642), an indication is provided to the game player, in block 646, that there are no cards available to play. A determination is then made in block 648 whether the player selected the "end of hole" button. If there are other cards in the stock pile or there are other cards with their front displayed that may be played in sequence on the home card ("No" to block 642), another selection is received from the game player in block 606 (FIG. 6A). If a determination is made that the player selected the "End of Hole" button, the score is displayed in block 670 (FIG. 6F).

Figure 6D:
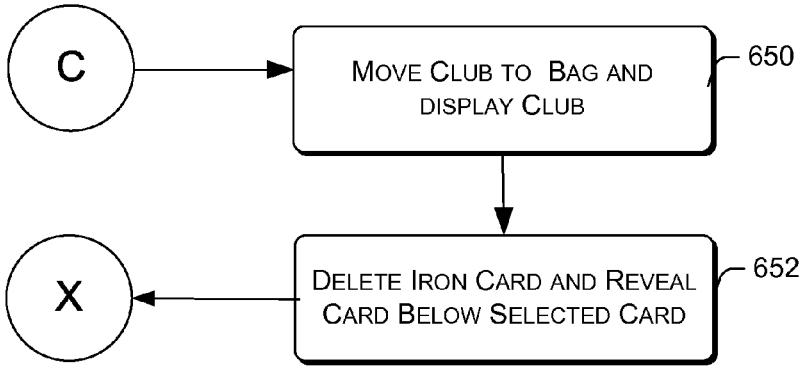
Figure 6E:
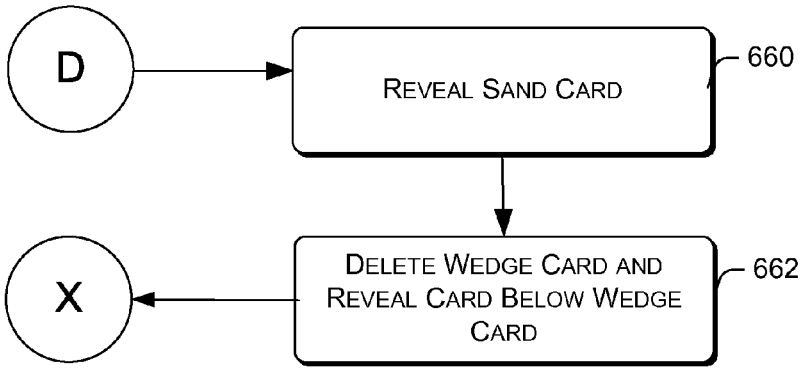
Figure 6F:
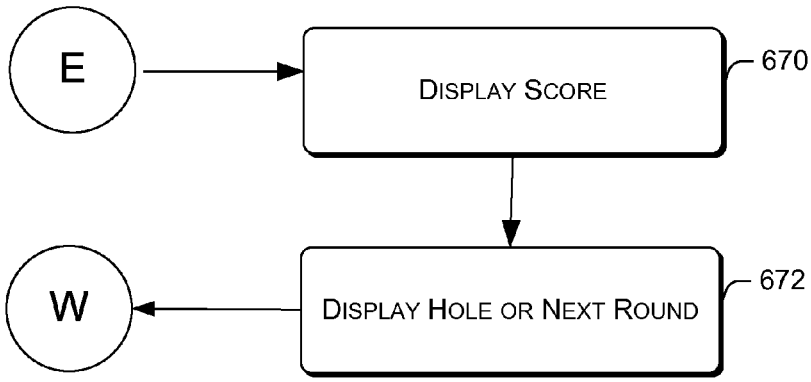

Referring to FIG. 6D, the selected iron or club card is moved to the bag, and the club with its number is displayed in block 652. In block 652, the iron card is then removed from display. Also the card that is positioned on the playing card pile below the removed iron card is revealed. The process then proceeds to block 606 where another selection is received (FIG. 6A).

Referring to FIG. 6E, the front of the sand card is revealed in block 660. In block 662, the wedge card is deleted, and the front of the card that was positioned on the playing card pile below the removed wedge card is revealed. The process then proceeds to block 606 where another selection is received (FIG. 6A).

Referring to FIG. 6F, the score is computed for the hole and automatically displayed in block 670. The computation may be done by subtracting the par value for the hole from the number of cards remaining in the hole. In addition a score may be computed by multiplying the multiplier by the sum of the points for each of the tokens collected. In block 672, the score for each of the holes and pars for the subsequent holes are also displayed. The game player may then select a button on the display indicating a desire to play the next hole. In response to the button selection, the process proceeds to block 604, where a new hole is displayed with a different: pile of playing cards having different front cards revealed, home cards, stock cards, hole and par value.

CONCLUSION

Above is described an apparatus and method for insertion of user selected graphics into a computer implemented video game. These and other techniques described herein may provide significant improvements over the current state of the art, to enable a non-technical individual to create and provide their own hidden objects game. Although the system and method has been described in language specific to structural features and/or methodological acts, it is to be understood that the system and method defined in the appended claims is not necessarily limited to the specific features or acts described. Rather, the specific features and acts are disclosed as illustrative forms of implementing the claimed system and method.

The invention claimed is:

1. A computer-implemented method for playing a video card game, the method comprising:

employing a processor that executes instructions retained in a non-transitory computer-readable medium, the instructions when executed by the processor implement at least the following operations:

setting a par value for a hole;

displaying a plurality of piles containing virtual playing cards having a front side and a back side, the front side displaying symbols comprising numbers and letters that are used to place the virtual playing cards in a contiguous order, the back side concealing the symbols, a portion of the virtual playing cards further indicating a golf club with a number;

displaying a front side of the virtual playing cards on the top of some of the plurality of piles;

displaying a back side of at least one other playing card that is positioned in one of the plurality of piles;

displaying a virtual home playing card disposed in a pile containing a single card;

displaying a pile of stock cards with at least one of the stock cards movable to the virtual home playing card;

receiving an indication of a selection by a game player of one of the virtual playing cards, and in response to the selection, simulating a removal of the selected virtual playing card from a top of one of the plurality of piles and placement onto the virtual home card in a contiguous order of symbols displayed on the front of the virtual playing cards, when the selection comprises the golf club with the number, placing the golf club with the number into a representation of a golf bag;

receiving an indication of a selection by the game player of the golf club in the golf bag, wherein the number of the golf club is placed on the front of the virtual home playing card;

revealing a front side of the at least one other playing card when the selected virtual playing card on the top of one or more of the plurality of piles is selected;

ending a hole when all the stock cards have been moved from the pile of stock cards to the virtual home card or when all the virtual playing cards have been moved from the plurality of piles and computing a score by subtracting the par value from the number of playing cards that remain in the plurality of piles; and providing a different score corresponding to a number of the virtual playing cards that remain in the plurality of piles after placing the virtual playing cards from the plurality of piles onto the virtual home playing card in the sequential order.

2. The method as recited in claim 1 further comprising:

displaying the front side of one of the virtual playing cards on the top of one of the plurality of piles; and displaying the symbols on the back side of the one of the virtual playing cards in one of the plurality of piles upon removal of one of the virtual playing cards from another one of the plurality of piles.

3. The method as recited in claim 2 wherein all of the virtual playing cards in one of the plurality of piles comprise an indication of a water trap.

4. A computer-implemented method for playing a video card game, the method comprising:

employing a processor that executes instructions retained in a non-transitory computer-readable medium, the instructions when executed by the processor implement at least the following operations:

displaying a plurality of piles containing virtual playing cards having a front side and a back side, the front side displaying symbols, numbers or letters that are used to place the virtual playing cards in a contiguous order, the back side concealing the symbols, numbers or letters;

displaying a front side of the virtual playing cards on the top of some of the plurality of piles;

displaying a back side of at least one other playing card that is positioned in one of the plurality of piles, the at least one other playing card indicating a golf club with a number;

displaying a virtual home playing card;

receiving an indication of a selection by a game player of one of the virtual playing cards, and in response to the selection, simulating a removal of the selected virtual playing card from a top of one of the plurality of piles and placement onto the virtual home card in a contiguous order of symbols displayed on the front of the virtual playing cards, when the selection comprises the golf club with a number, placing the golf club with a number in a golf bag;

concealing a symbol, number or letter of one of the virtual playing cards on the top of one of the plurality of piles and revealing the concealed symbol, number or letter upon selection of the golf club with a number;

revealing a front side of the at least one other playing card when the selected virtual playing card on the top of one or more of the plurality of piles is selected; and providing a score corresponding to a number of cards that remain in the one or more plurality of piles after placing playing cards from the piles onto the virtual home playing card in the sequential order.

5. The method as recited in claim 4 wherein the golf club with a number is a wedge.

6. A non-transitory computer readable medium having instructions for playing a video game with a display device, the instructions when executed by one or more processors comprise:

displaying a plurality of piles containing virtual playing cards on the display device, each of the plurality of piles having a top virtual playing card and other cards below the top virtual playing card, the virtual playing cards having a front side indicating symbols, letters or numbers that are used to create a contiguous card order, and a back side that conceal the symbols, letters or numbers;

displaying a front side of some of the top virtual playing cards and a back side of some of the top virtual playing cards;

displaying a virtual home playing card;

receiving an input signal from a user indicating a selection of one of the top virtual playing cards on one of the plurality of piles;

in response to the input signal, simulating a removal of the selected top virtual playing card and placement of the selected top virtual playing card onto the virtual home playing card in the contiguous card order;

displaying a back side of at least one other virtual playing card underneath the selected top virtual playing card, and revealing a front side of the at least one other virtual playing card underneath the selected top virtual playing card when the selected top virtual playing card is placed on the virtual home playing card;

providing a stock pile from with which to remove virtual stock cards and place on the virtual home playing card, and indicating in a pop up dialog box upon removal of one of the virtual stock cards an indication of a wild shot card that when selected enables the game player to select a drop button or a play button, wherein when the user selects the drop button a random card is chosen to be moved to the virtual home playing card, and when the user selects the play button, actions occur from one or more from the group of actions including: automatically adding virtual stock cards to the plurality of piles, automatically removing virtual stock cards from the plurality of piles, automatically adding tokens, automatically removing tokens, automatically reducing a scoring multiplier or automatically increasing a scoring multiplier;

continuing to receive input signals from the user and to simulate removal and placement of the virtual playing cards until the top virtual playing cards of the plurality of piles cease to be contiguous with a most recent virtual playing card placed onto the virtual home card; and providing a score corresponding to a number of the virtual playing cards that remain in the plurality of piles after placing the virtual playing cards from the plurality of piles onto the virtual playing card in the contiguous card order.

7. The computer readable medium as recited in claim 6, further comprising receiving an input signal to place one of the at least one other card on the virtual home playing card when the virtual playing cards on the plurality of piles cease to be contiguous with the most recent virtual playing card placed onto the virtual home playing card.

8. The computer readable medium as recited in claim 6 further comprising:

indicating a mulligan button on the display device;

receiving an indication of a selection of the mulligan button; and in response to the mulligan button being selected, placing a most recently moved virtual playing card back on one of the plurality of piles from which the most recently moved virtual playing card was moved.

9. The computer readable medium as recited in claim 6 further comprising indicating a internet chat window adjacent to a window where the video game is displayed, and automatically indicating activities that occur in the video game in the chat window.

10. A computer-implemented method for playing a video card game, the method comprising:

employing a processor that executes instructions retained in a non-transitory computer-readable medium, the instructions when executed by the processor implement at least the following operations:

setting a par value for a hole;

displaying a plurality of piles containing virtual playing cards having a front side and a back side, the front side displaying symbols comprising numbers and letters that are used to place the virtual playing cards in a contiguous order, the back side concealing the symbols comprising numbers and letters;

displaying a front side of top playing cards of some of the plurality of piles of a first type;

displaying a back side of the virtual playing cards positioned underneath at least one of the top playing cards in one of the plurality of piles of a second type, the back side labeled as a water trap;

displaying a virtual home playing card;

displaying a pile of stock cards with at least one of the stock cards being movable to the virtual home playing card;

receiving an indication of a selection by a game player of one of the top playing cards, and in response to the selection simulating a removal of the selected top playing card from the plurality of piles of the first type and placement onto the virtual home playing card in a contiguous order of symbols comprising numbers and letters;

revealing a front side of one other virtual playing card when the selected top playing card is selected;

revealing the front side of a top playing card on one of the plurality of piles of the first type upon removal of all of the virtual playing cards from one of the plurality of piles of the second type; and ending a hole when all the stock cards have been moved from the pile of stock cards to the virtual home playing card or when all the virtual playing cards have been moved from the plurality of piles and computing a score by subtracting the par value from a number of playing cards that remain in the plurality of piles.

11. The method as recited in claim 10 further comprising simultaneously playing the video card game with multiple game players, indicating a internet chat window adjacent a window where the video card game is displayed for each of the game players, and automatically indicating activities that occur in the video card game in the chat window of one game player of actions that occur with each of the multiple game players.

12. The method as recited in claim 11 further comprising awarding tokens to each of the multiple game players when actions are indicated in the chat window for successfully completing a shared event.

* * * * *